US007100696B2

(12) United States Patent
Marshall

(10) Patent No.: US 7,100,696 B2
(45) Date of Patent: Sep. 5, 2006

(54) DISCONNECT FOR USE IN A WELLBORE

(75) Inventor: Greg Marshall, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 323 days.

(21) Appl. No.: 10/237,565

(22) Filed: Sep. 9, 2002

(65) Prior Publication Data

US 2003/0062169 A1 Apr. 3, 2003

Related U.S. Application Data

(60) Provisional application No. 60/326,408, filed on Oct. 1, 2001.

(51) Int. Cl.
*E21B 23/00* (2006.01)

(52) U.S. Cl. ..... 166/377; 166/242.6; 285/4

(58) Field of Classification Search ..... 166/377, 166/242.6, 242.7, 125, 317, 318, 376; 285/3, 285/4, 2, 34, 35, 924
See application file for complete search history.

(56) References Cited

U.S. PATENT DOCUMENTS 4,175,778 A * 11/1979 Nunez et al. ..... 285/3
4,497,371 A * 2/1985 Lindsey, Jr. ..... 166/377
4,986,690 A 1/1991 Cooksey ..... 403/319
4,993,493 A * 2/1991 Arnold ..... 166/382
5,135,264 A * 8/1992 Elliott-Moore ..... 285/2
5,219,027 A * 6/1993 Taylor ..... 166/377
5,526,888 A * 6/1996 Gazewood ..... 175/320
5,580,099 A * 12/1996 Eaton ..... 285/35
5,787,982 A 8/1998 Bakke ..... 166/242.6
6,131,953 A 10/2000 Connell et al. ..... 285/3
6,199,632 B1 * 3/2001 Shy ..... 166/242.6
6,450,541 B1 * 9/2002 Bakke ..... 285/2

FOREIGN PATENT DOCUMENTS

WO WO 9832946 A1 * 7/1998

OTHER PUBLICATIONS

PCT International Search Report, International Application No. PCT/GB 02/04341, dated Dec. 27, 2002.

* cited by examiner

*Primary Examiner*—David Bagnell
*Assistant Examiner*—Nicole A Coy
(74) *Attorney, Agent, or Firm*—Patterson & Sheridan, LLP

(57) ABSTRACT

The present invention generally relates to a disconnect for use in a wellbore to separate a tubular string from a stuck wellbore component. In one aspect, the invention includes a disconnect with a first portion and a second portion and a lock nut preventing the separation of the two portions. When a predetermined fluid force is applied to a piston in the disconnect, a tensile sleeve fails and the first and second portions of the disconnect separate, thereby leaving a portion of the disconnect in the wellbore with the stuck component. In one embodiment, the tensile sleeve's failure permits an annular piston to dislodge a wedge sleeve from the lock nut, thereby permitting separation of the first and second portion of the disconnect.

16 Claims, 8 Drawing Sheets

DISCONNECT FOR USE IN A WELLBORE

CROSS-REFERENCE TO RELATED APPLICATIONS

This application claims benefit of U.S. provisional patent application Ser. No. 60/326,408, filed Oct. 1, 2001, which is herein incorporated by reference.

BACKGROUND OF THE INVENTION

1. Field of the Invention

The present invention generally relates to an apparatus and method for use in a wellbore. More particularly, the invention relates to a disconnect for separating two or more components in a wellbore.

2. Description of the Related Art

In the drilling, completion, and operation of a hydrocarbon wells, various wellbore components are inserted and removed from a previously drilled wellbore on a lower end of a tubular string. Wellbore components include packers (to seal off production zones), motors, pumps, sensors, sliding sleeves (to control flow of fluid in and out of production tubing), hydraulically set liners (for lining during cementing of casing), whipstocks (to divert drill bit while drilling), valves, cement shoe assemblies, and drill bits.

As wellbore components are delivered and removed from a wellbore, the components or the tubular string they are attached to can become stuck in the wellbore. The problem is exacerbated by non-liner wellbores or previously existing obstructions in the wellbore. In one example, a drill bit on an end of a drill string is used to increase the depth of the wellbore. As the drill rotates at the end of the string, it may become stuck or otherwise jammed in the wellbore. There are conventional wellbore devices that are designed to aid in freeing a component that is stuck in the wellbore. For example, a "jar" can be disposed in the drill string to selectively provide a jarring force to the stuck component. A jar includes a telescopic portion that permits axial elongation of the jar. By operating a jar that is disposed near the stuck component, a force can be developed to possibly free the component.

In other instances, the use of jars is inadequate to free a stuck component and the component must be exposed in the wellbore in order to remove it with the use of fishing tools. To permit a drill sting or other tubular string to be separated from a stuck component, disconnect devices, are placed at intervals in the drill string. A disconnect is a component that can be selectively separated into two portions. For example, a disconnect disposed in a string of tubulars can permit the string to be separated and the lower part left in the wellbore for accessibility by fishing tools. Likewise, a disconnect disposed between the end of a tubular string and a wellbore component, like a drill bit, permits the selective removal of the string of tubulars if the bit should become stuck.

Conventional pull type disconnects utilize shear pins to temporarily couple a first and second portion of the disconnect together or to hold an internal piston in a first position. Shear pins are designed to fail when they are subjected to a force, such as a tensile or compressive force developed across the pins. When a wellbore component is stuck and a disconnect is disposed in a tubular string near the component, an upward force applied from the surface can cause the shear pins of the disconnect to fail, permitting the string to be removed from the wellbore. After the tubular string is retrieved to the surface, a fishing tool is used to manipulate the stuck wellbore component.

Shear pins are sized and numbered based upon the shear force needed to operate a disconnect. While they have been used as temporary connections in wellbores for years, shear pins have limitations. For example, forces other than the intended force may prematurely cause the shear pins to shear, thus making them unreliable. Because the shear pins can shear prematurely, additional fishing operations may be required to retrieve the prematurely disconnected wellbore component, leading to lost production time. For example, shear pins located on a tubular string that includes a perforating gun can shear prematurely from the force generated when the perforating gun is fired. Additionally, shear pins can shear prematurely when a slide hammer bangs on a shifting tool in order to shift the sliding sleeve or when a jarring device is used to dislodge a component.

Therefore, there is a need for a more reliable disconnect for use in a wellbore. There is a further need for a disconnect that can operate only when a predetermined amount of tension force is applied to a member.

SUMMARY OF THE INVENTION

The present invention generally relates to a disconnect for use in a wellbore to separate a tubular string from a stuck wellbore component. In one aspect, the invention includes a disconnect with a first portion and a second portion and a lock nut preventing the separation of the two portions. When a predetermined fluid force is applied to a piston in the disconnect, a tensile sleeve fails and the first and second portions of the disconnect separate, thereby leaving a portion of the disconnect in the wellbore with the stuck component. In one embodiment, the tensile sleeve's failure permits an annular piston to dislodge a wedge sleeve from the lock nut, thereby permitting separation of the first and second portion of the disconnect.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
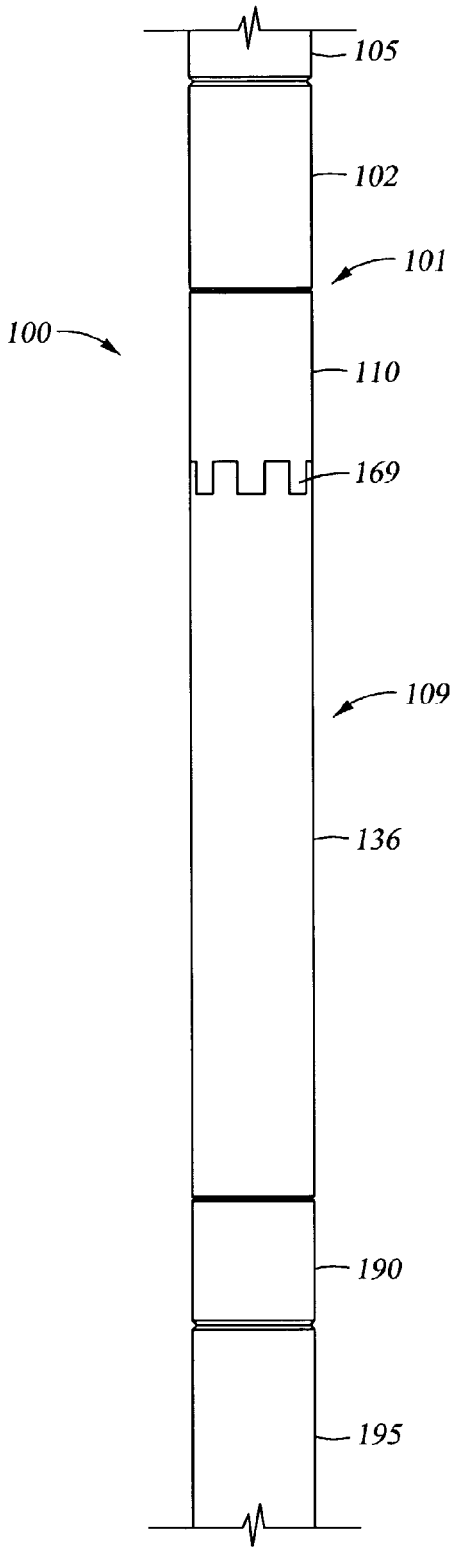
FIG. 1 is an elevation view of the disconnect showing a castellation arrangement between a first and a second portions of the disconnect.

The present invention provides an apparatus and method to disengage a wellbore component from a tubular string. A disconnect device having a first and second portion and a tensile sleeve is provided to disengage the wellbore component from the tubular string. The tensile sleeve includes a notch defining a portion of reduced thickness within the sleeve that can be caused to fail when a predetermined amount of force is applied. Additionally, a lock nut and a wedge sleeve operate to retain the first and second parts of the disconnect together prior to the failure of the tensile sleeve FIG. 1 is an elevation view of a disconnect 100 showing a castellation arrangement between a first 101 and a second 109 portions of the disconnect. The castellation members 169 of a housing 136 and a mandrel 110 prevent the first and second portions 101, 109 from rotating in relation to each other. Additionally, a tubular 105 is coupled to an upper sub 102 that is coupled to the mandrel 110. The housing 136 is coupled to the lower sub 190 that is coupled to a wellbore component 195 or a tubular.

Figure 2:
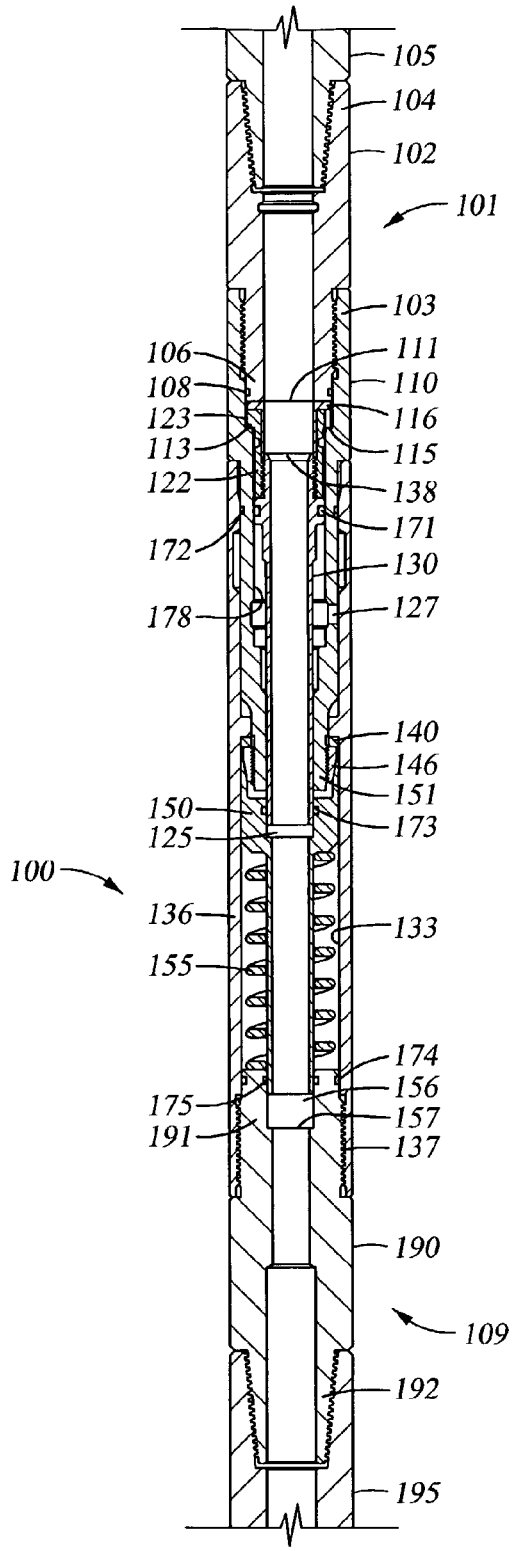
FIG. 2 is a section view of a disconnect of the present invention.

FIG. 2 is a section view of a disconnect 100 of the present invention. Specifically visible in FIG. 2 are the first 101 and second 109 portions of the disconnect 100. The first portion 101 includes upper sub 102, the mandrel 110 having a bore therethrough, a wash out sleeve 116, o-rings 108, 171, 172, a tensile sleeve 122, an aperture 127, and an annular piston 130 with a ball seat 138 at the upper end thereof. The tensile sleeve 122 includes an upper portion 113 with a flange 123 that is shown seated on a shoulder 115 of the mandrel 110. The second portion 109 includes the housing 136, a thrust washer 140, a lock nut 146, a wedge sleeve 150, spring 155, o-rings 173, 174, 175 and a lower sub 190. The first portion 101 and the second portion 109 are coupled together by the lock nut 146.

As stated above, the first portion 101 includes the upper sub 102 having an upper end 104 threaded to the tubular string 105 and a lower end 106 threaded to the upper end 103 of the mandrel 110. As shown, a gap 111 is formed between the lower end 106 of the upper sub 102 and the washout sleeve 116 to provide a fluid pathway. Additionally, the upper sub 102 provides a connection between the tubular string 105 and the disconnect 100. O-ring 108 provides a seal between the mandrel 110 and the upper sub 102 to prevent fluid flow thereinbetween. A lower end 151 of the mandrel 110 is threaded in order to mate with the threads of the lock nut 146.

Still referring to FIG. 2, the piston 130 is slideably coupled to an inner surface 178 of the mandrel 110 and moves axially in response to an axial force. O-ring 171 provides a fluid seal between the piston 130 and the mandrel 110. Additionally, the aperture 127 is provided in a wall of the mandrel 110 to allow fluid from the upper portion 101 of the disconnect 100 to escape to an annulus created between the wellbore and the disconnect 100. The aperture 127 and its function will become apparent with respect to FIGS. 8 and 9.

Piston 130 includes the ball seat 138 at an upper end thereof for the seating of a ball (not shown) in order to seal the bore of the disconnect 100 and develop a fluid force above the piston 130. In another embodiment, the piston 130 may include a restricted bore to create a fluid force. The piston 130 can move axially within the mandrel 110 to engage the wedge sleeve 150, a portion of the second portion 109 of the disconnect 100. The spring 155 biases the wedge sleeve 150 against the lock nut 146, which is in contact via threads with the lower end 151 of the mandrel 110. The lock nut 146 is a "C" shaped ring and is normally outwardly biased away from the threaded mandrel 110. When in contact with the lock nut 146, the wedge sleeve 150 urges the lock nut 146 inwards and into contact with the mating threads of the mandrel 110, thereby retaining the upper 101 and lower 109 portions of the disconnect 100 together. The wedge sleeve 150 is designed to move axially along an inner wall 133 of the housing 136, when the piston 130 travel pass gap 125 and engages shoulder 126 (FIG. 7) of the sleeve. In doing so, the outwardly biased lock nut 146 moves out of engagement with the threaded mandrel 110. O-ring 173 provides a fluid seal between the piston 130 and the wedge sleeve 150. Thrust washer 140 provides a cushion against jarring forces that can cause the lock nut 146 to jar and damage the housing 136.

Still referring to FIG. 2, the housing 136 is threaded at a lower end 137 to an upper end 191 of the lower sub 190. The housing 136 provides an enclosure for a portion of the mandrel 110, the piston 130, the lock nut 146, the wedge sleeve 150, the thrust washer 140, the spring 155, the o-rings 173, 174, 175. O-rings 174, 175 provides a seal between the lower sub 190 and the housing 135 and between the piston 130 and lower sub 190, respectively. Additionally, o-ring 172 provides a fluid seal between the housing 136 and mandrel 110. The lower sub 190 has the upper end 191 threaded to the lower end 137 of the housing 136 and lower end 192 can be threaded to a wellbore component 195 or a tubular string. A gap 156 provided between the wedge sleeve 150 and the lower sub 190 permits the sleeve to move axially. Additionally, the lower sub 190 has a stop shoulder 157 to prevent the wedge sleeve 150 from moving pass the spring's 155 elastic limit when the sleeve 150 moves axially.

Figure 3:
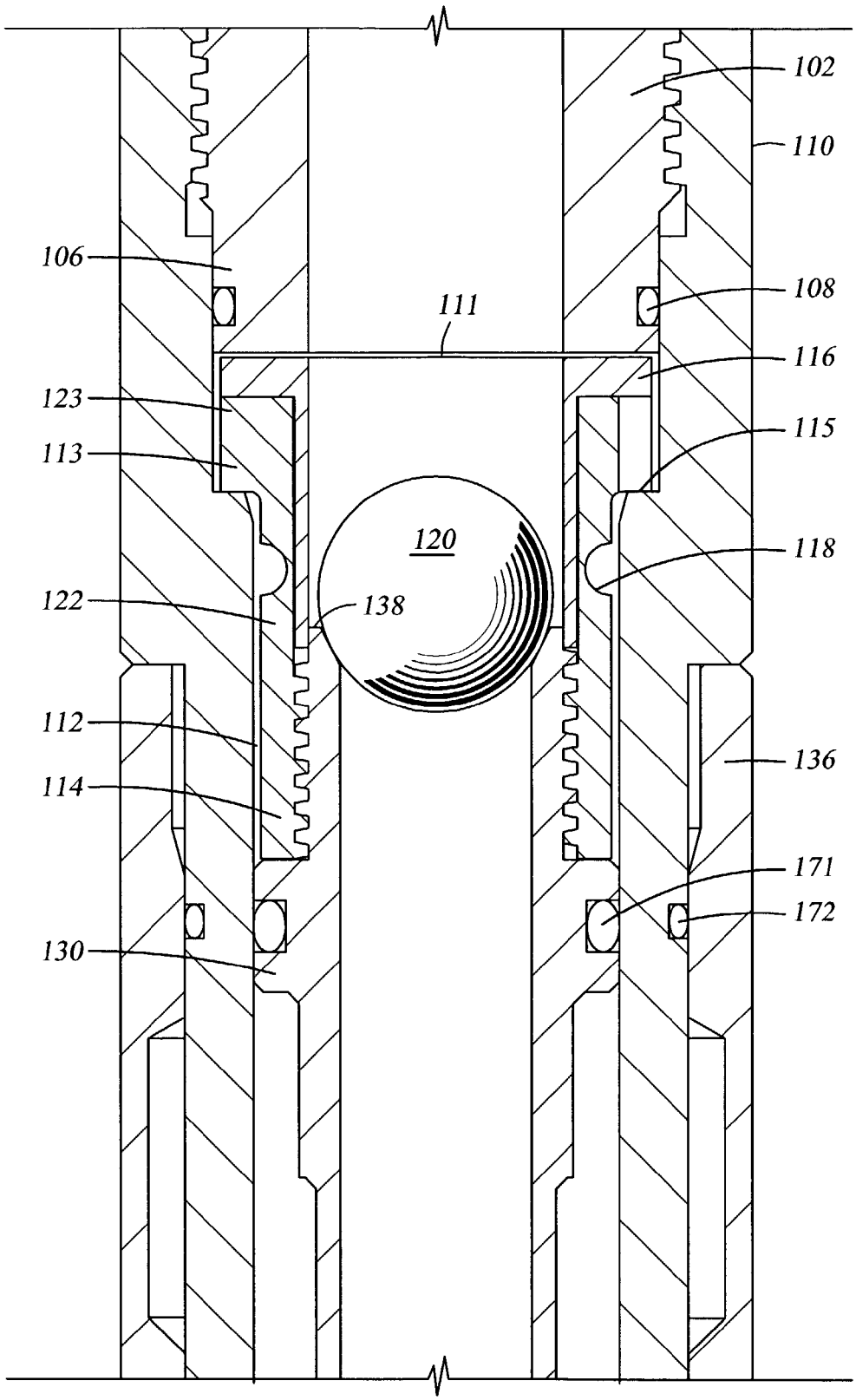
FIG. 3 is an enlarged view of the disconnect in the area around the tensile sleeve.

FIG. 3 is an enlarged view of the disconnect 100 in the area around the tensile sleeve 122. The washout sleeve 116 supports the tensile sleeve 122 that is disposed thereon, and protects the tensile sleeve 122 from being damaged by abrasive fluids that may flow through from the upper sub 102 to the lower sub 190 (not shown) during hydrocarbon production.

Figure 5:
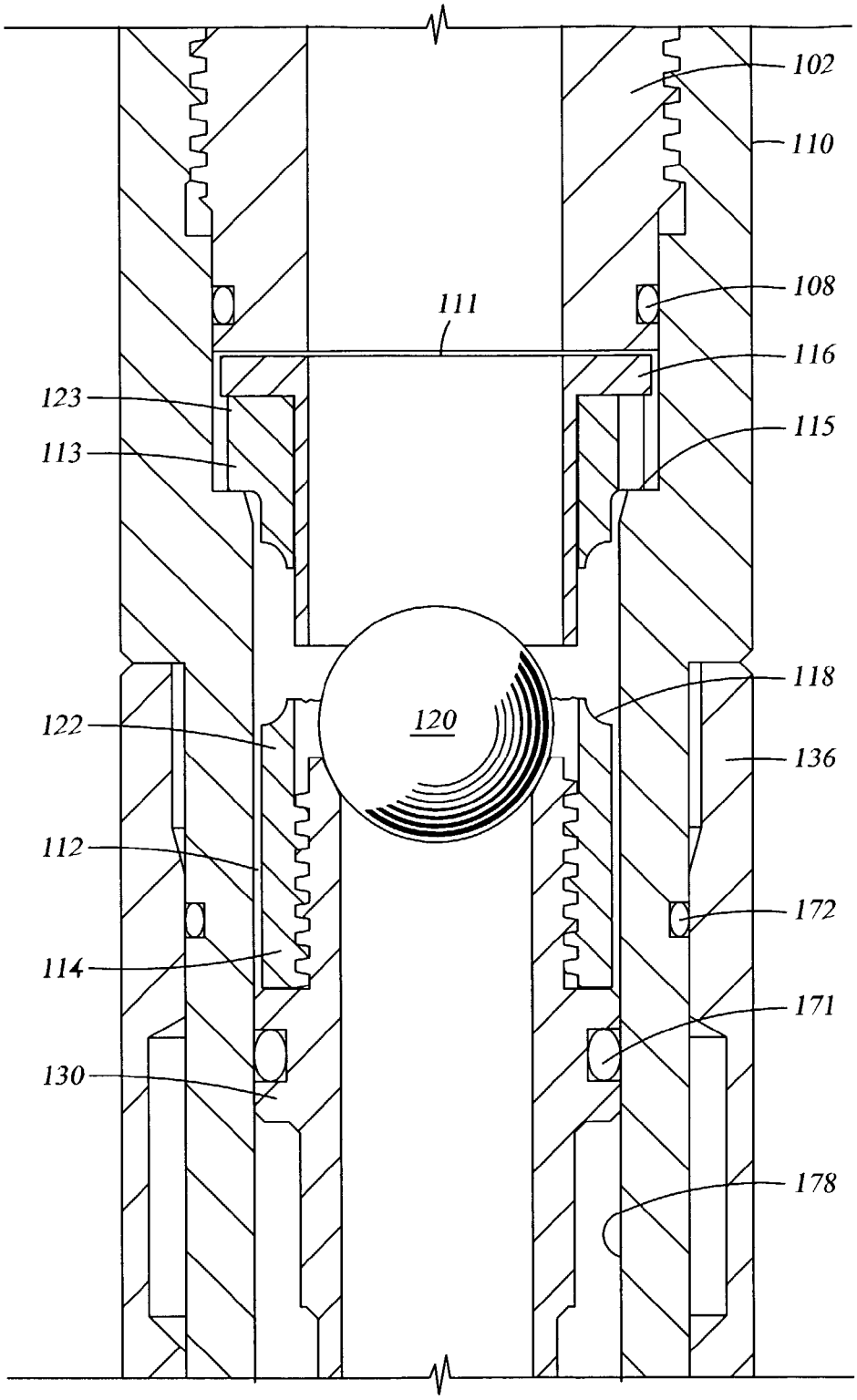
FIG. 5 is a section view illustrating the tensile sleeve after it has failed.

The tensile sleeve 122 may be an annular sleeve having a notch 118 or some other strength reducing formation that divides the tensile sleeve 122 into the upper portion 113 and a lower portion 114. The upper portion 113 includes the flange 123 that is shown seated on the shoulder 115 of mandrel 110. The lower portion 114 of the sleeve 122 is threaded to the piston 130. In this manner, the tensile sleeve 122 is retained between the mandrel 110 and the piston 130 and a tensile force may be applied thereto as the piston is urged downward as will be described. Illustrated in FIG. 3 is a ball 120 seated in the ball seat 138 of the piston 130. Typically, when the disconnect is 100 to be operated, the ball 120 is dropped from above and lands in the ball seat 138 thereby blocking the flow of fluid in the bore of the disconnect 100 and permitting fluid pressure to be developed above the ball 120 and piston 130. The depth of the notch 118 determines the amount of force required to separate the upper portion 113 from the lower portion 114 of the tensile sleeve 122 or a predetermined failure force of the notch 118. When a fluid force acts upon the piston 130 via the ball 120, the piston 130 places a tensile force on the tensile sleeve 122 because flange 123 of the upper portion 113 is seated in the shoulder 115 of the mandrel 110. When the predetermined failure force is reached, the sleeve 122 is separated into upper portion 113 and lower portion 114 (FIG. 5). Also visible in FIG. 3 is the gap 111 formed between the upper sub 102 and the washout sleeve 116 providing a fluid pathway into the chamber 112 formed around an outer surface of the tensile sleeve 122. The chamber 112 permits fluid communication along an outer surface of the sleeve 122 to equalize pressure.

Figure 4:
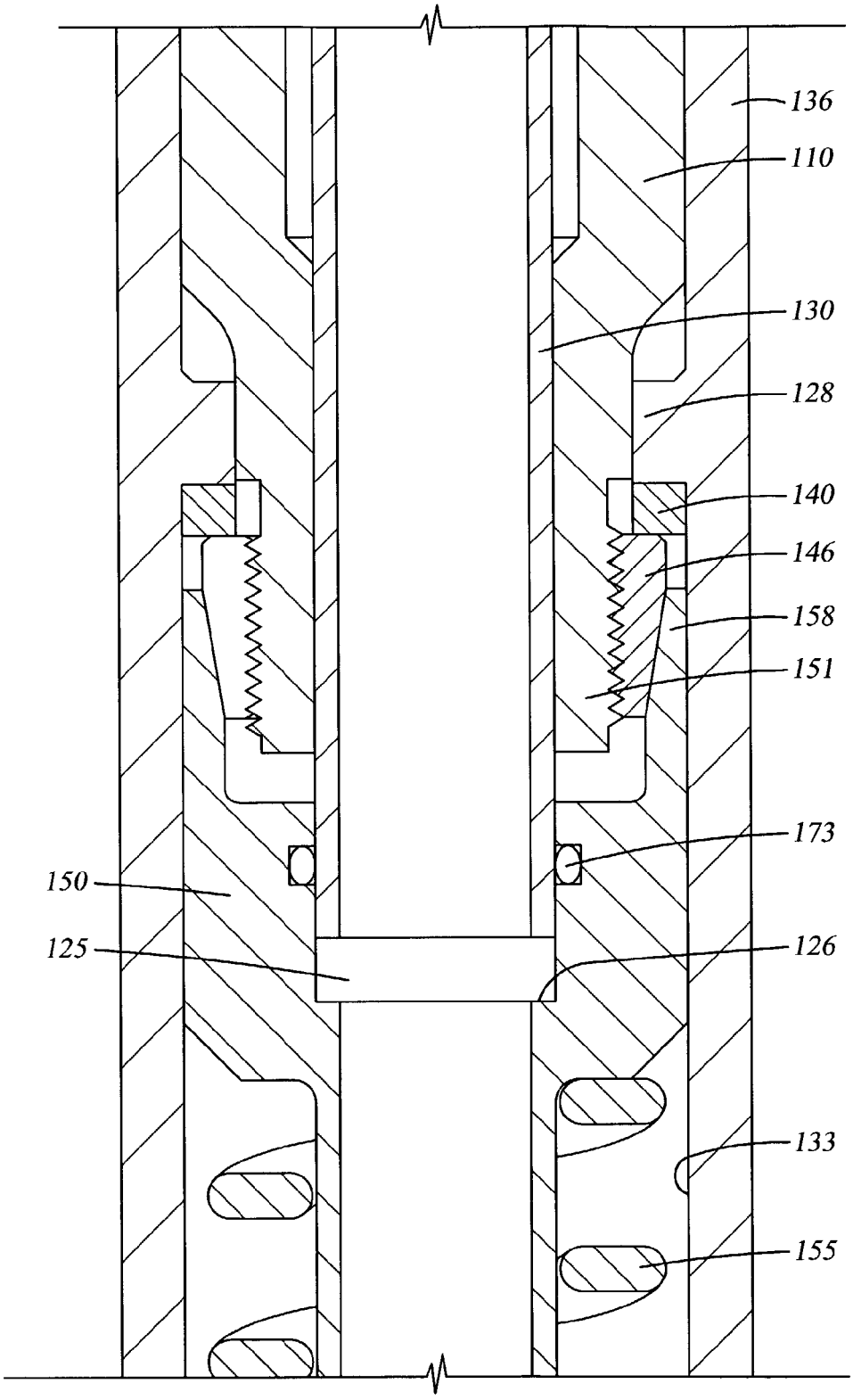
FIG. 4 is an enlarged view of the area of the disconnect surrounding lock nut.

FIG. 4 is an enlarged view of the area of the disconnect 100 surrounding lock nut 146. As illustrated, threaded inner portion of the lock nut 146 is mated with threads formed in the lower end 151 of the mandrel 110, thereby fixing the lock nut 146 to the mandrel 110. At an outer surface, the lock nut 146 is controlled by the wedge sleeve 150 and its upper portion 158 and thus urged into contact with the mandrel 110. Spring 155 urges the wedge sleeve 150 towards the lock nut 146, thereby keeping the lock nut 146 engaged.

Another concern of conventional disconnect devices is the possibility of bending movements that can occur where the upper and lower portions 101, 109 are connected together. In the present invention, because the wedge sleeve 150 is wedged tightly with the lock nut 146, any bending movement is severely restricted. Additionally, the wedge sleeve 150 has the shoulder 126 to receive the lower end of the piston 130, when the piston 130 travels across gap 125. The thrust washer 140 is disposed between the lock nut 146 and a flange 128 of the housing 136. Additionally, the o-ring 173 provides a seal between the wedge sleeve 150 and the piston 130.

FIG. 5 is a section view illustrating the tensile sleeve 122 after it has failed. With the ball 120 seated at the top of the piston 130, fluid pressure is applied to the ball 120 and piston surface. When the predetermined failure force of the tensile sleeve 122 is reached, the sleeve 140 separates into its upper and lower portions 113, 114. Thereafter, the piston 130 is free to move downward in the disconnect 100.

Figure 6:
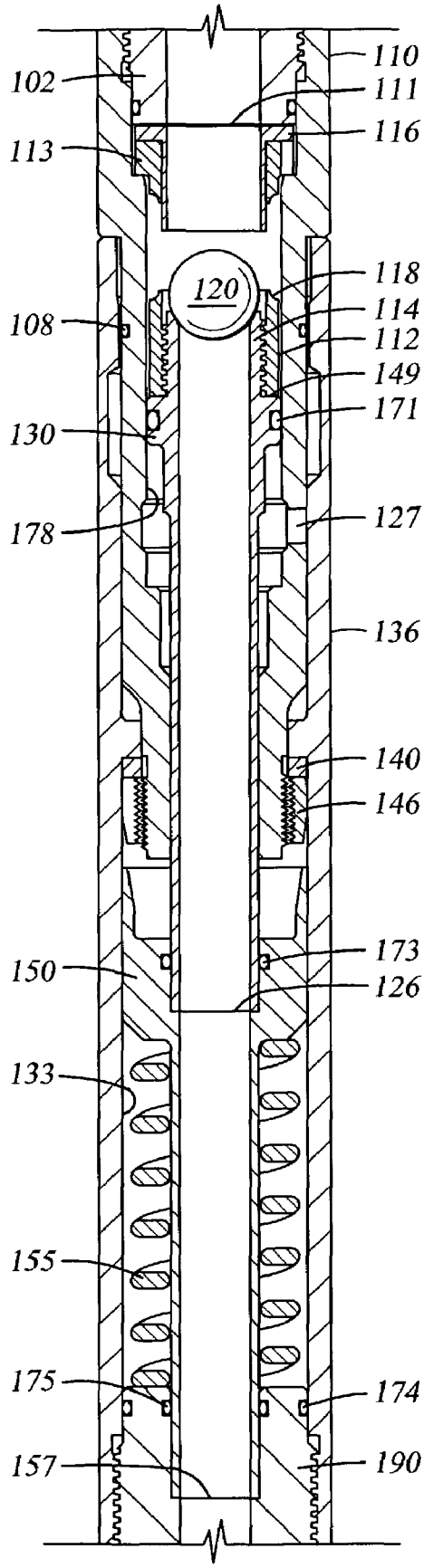
FIG. 6 is a section view of the disconnect illustrating the position of the components as the device is operated.
Figure 7:
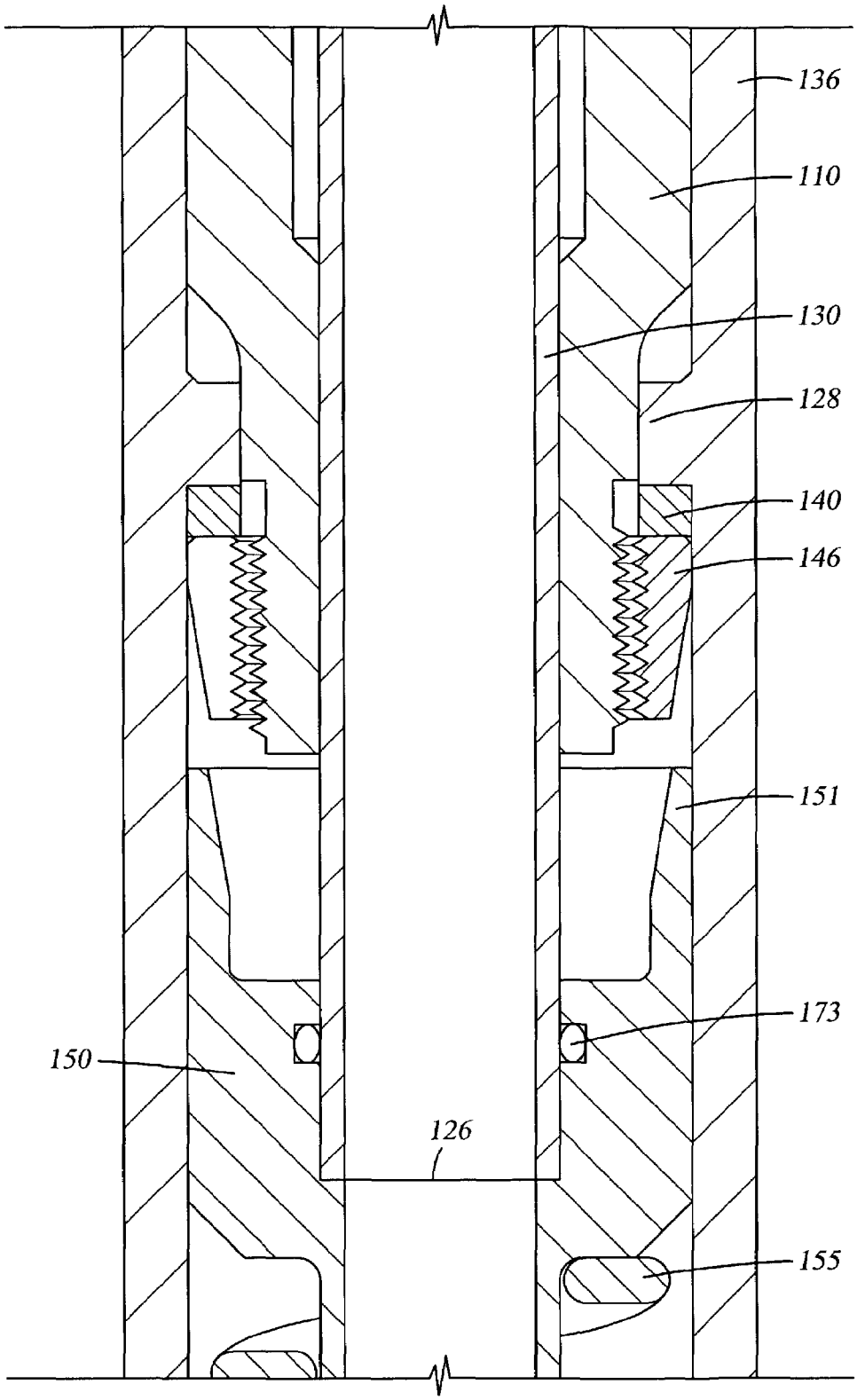
FIG. 7 is an enlarged section view in the area of the lock nut.

FIG. 6 is a section view of the disconnect 100 illustrating the position of the components as the device is operated. FIG. 7 is an enlarged section view in the area of the lock nut 146.

The piston 130, with the ball 120, continues to move axially along the inner wall 178 of the mandrel 110 and crosses the gap 125 (not shown) and engages the shoulder 126 of the wedge sleeve 150. The piston 130 then moves the wedge sleeve 150 axially along the inner wall 133 of the housing 136, and against the bias force of the spring 155, thereby compressing the spring 155.

When the wedge sleeve 150 moves axially along the inner wall 133 of the housing 136, it is moved out of the engagement with the lock nut 146 thereby, allowing the nut to move out of engagement with the mandrel 110 and decoupling the first and second portions 101, 109 of the disconnect 100 from each other. This relationship is illustrated in FIG. 7. The wedge sleeve 150 continues moving axially due to the movement of the piston 130, crosses gap 156 (not shown) and engages stop shoulder 157 (not shown) to further compress the spring 155. However, stop shoulder 157 on the lower sub 190 (not shown) prevents the wedge sleeve 150 from traveling beyond the spring's 155 elastic limit.

Figure 8:
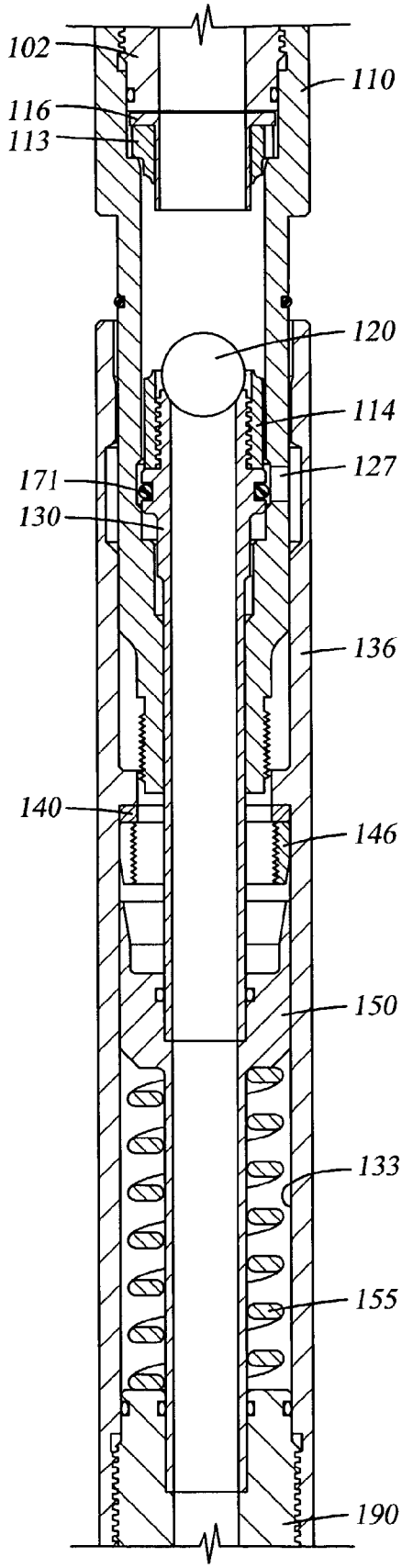
FIG. 8 is a section view of the disconnect illustrating the disconnect just prior to separation of the first and second portions.

FIG. 8 is a section view of the disconnect 100 illustrating the disconnect 100 just prior to separation of the first and second portions 101, 109. As previously described, the piston 130 and ball 120 travel axially downwards in the disconnect 100 after the upper portion 113 and lower portion 114 separate due to fluid pressure. The downward movement of the piston 130 urges the wedge sleeve 150 out of contact with the lock nut 146 and the threads of the mandrel 110 come out of engagement with the threads of the lock nut 146. Thereafter, as shown in FIG. 8, continued fluid pressure applied to the piston 130 and ball 120 cause axial movement of o-ring 171 past a port 127 formed in a wall of the mandrel 110. As the fluid is diverted, its pressure necessarily drops and the change in pressure can be measured and noted out of the surface of the well.

The sudden change in pressure indicates that not only are the threads of the mandrel 110 out of engagement with the threads of the lock nut 146, but that the mandrel 110 is at an axial position within the housing 136 of the disconnect 100 whereby, re-engagement between the threads will not result. Thereafter, the first portion 101 of the disconnect 100 may be pulled out of the wellbore, leaving the second portion 109, and any stock component there below, accessible by fishing tools.

Figure 9:
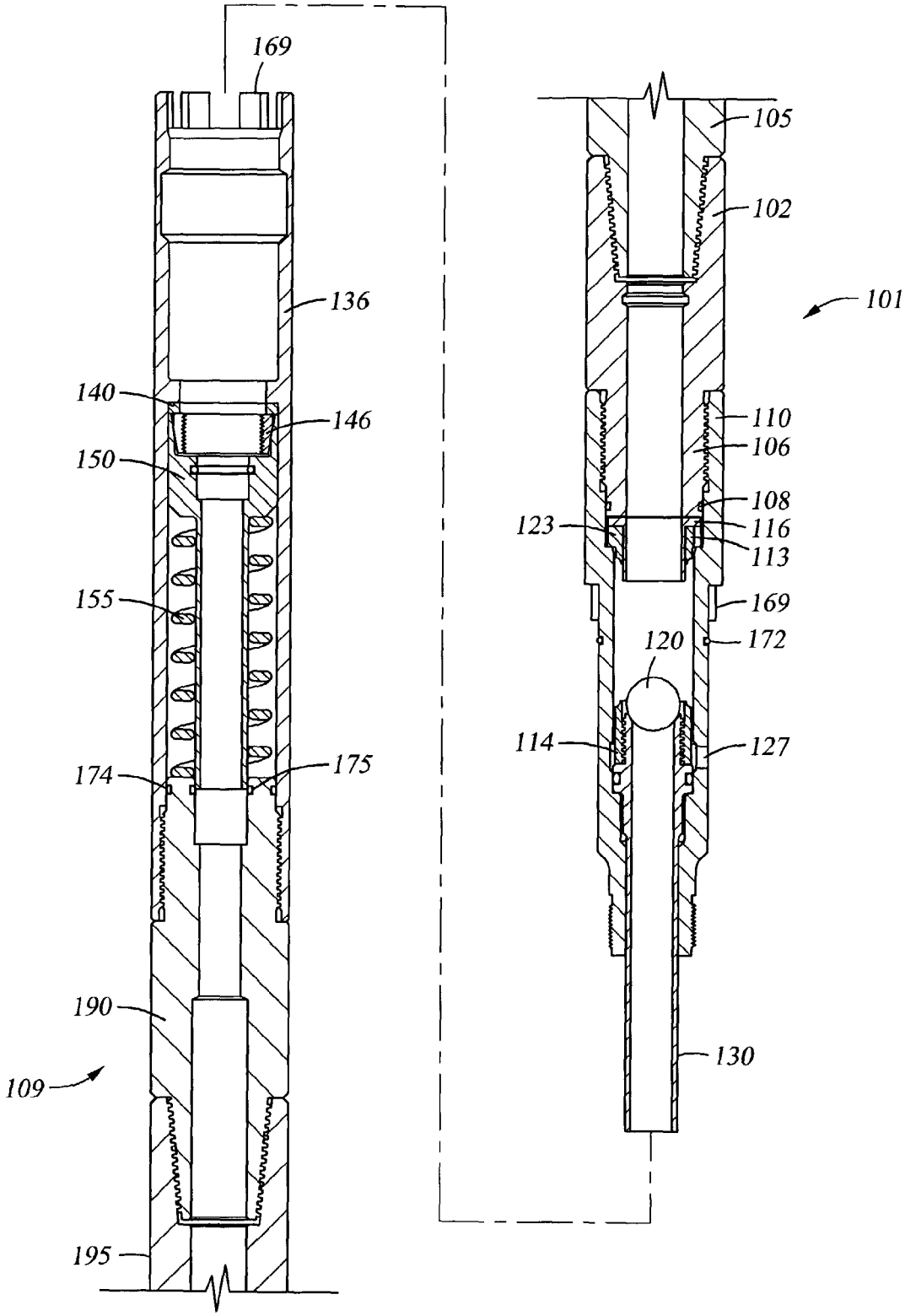
FIG. 9 is a section view showing the first portion of the disconnect removed from the second portion.

FIG. 9 is a section view showing the first portion 101 of the disconnect removed from the second portion 109. Typically, the portion remaining in the wellbore includes a profile or some other formation accessible by a fishing tool.

While the foregoing is directed to embodiments of the present invention, other and further embodiments of the invention may be devised without departing from the basic scope thereof, and the scope thereof is determined by the claims that follow.

The invention claimed is:

1. A method of operating a disconnect in a wellbore comprising:

running the disconnect into a wellbore disposed between a tubular and another tubular or a component;

increasing pressure against a piston until a strength reducing formation fails;

causing the piston to move from a first non-contact position relative to a shoulder of a retaining member to a second position where the piston contacts said shoulder of the retaining member and moves the retaining member out of engagement with a connection member, thereby disengaging a first portion of the disconnect from a second portion thereof; and removing the first portion from the wellbore.

2. The method of claim 1, further including pulling upwards on the first portion until a pressure drop occurs.

3. A disconnect for use in a wellbore, the disconnect comprising:

a first portion for attachment to a first wellbore component or tubular string;

a second portion for attachment to a second wellbore component or tubular string;

a tensile sleeve having at least one strength reducing feature and constructed and arranged to fail at a predetermined tensile force applied thereto;

a lock nut assembly including a C-ring having a threaded inner surface and a mandrel having a threaded outer surface for temporarily connecting the first and second portions together, wherein the lock nut assembly is constructed and arranged to become disengaged after the tensile sleeve fails;

a piston, the piston held in a first non-contact position relative to a wedge sleeve until the tensile sleeve fails and thereafter moving to a second position where the piston contacts a shoulder of the wedge sleeve to release the lock assembly; and the wedge sleeve having a wedge-shaped member at a first end that holds the C-ring into engagement with the mandrel, the wedge sleeve held in engagement with the C-ring by a spring disposed at a second end thereof, whereupon arrival of the piston at the second position, the wedge-shaped member is urged out of engagement with the C-ring, thereby permitting the lock nut assembly to be disengaged.

4. The disconnect of claim 3, wherein an upper surface of the piston receives a ball therein to seal the flow of fluid therethrough and permit pressure to be developed against the piston and ball and a subsequent force acting upon the tensile sleeve.

5. The disconnect of claim 4, wherein the tensile sleeve has an outwardly extending shoulder formed at an upper end thereof, the shoulder seatable on an inwardly facing shoulder of the mandrel.

6. The disconnect of claim 5, wherein the tensile sleeve further includes an attachment member to attach to an upper portion of the piston.

7. A tool for use in a wellbore, the tool comprising:

a first member;

a second member;

a strength reducing formation formed on a sleeve, wherein the strength reducing formation is constructed and arranged to fail at a predetermined force;

a connection assembly to provide a temporary connection between the first and the second member, whereby the connection assembly allows the first and second member to disconnect after the strength reducing formation fails;

a biased wedge sleeve interfering with the connection assembly to ensure the connection assembly remains engaged until the strength reducing formation fails; and a piston, the piston held in a first non-contact position relative to the wedge sleeve until the strength reducing formation fails and thereafter the piston moves to a second position into contact with a shoulder of the wedge sleeve to move the wedge sleeve out of engagement with the connection assembly, thereby releasing the connection assembly.

8. A tool for use in a wellbore, the tool comprising:

a first member;

a second member;

a strength reducing formation constructed to fail at a predetermined force, wherein the strength reducing formation is formed on a sleeve;

a connection assembly to provide a temporary connection between the first and the second member, whereby the connection assembly allows the first and second member to disconnect after the strength reducing formation fails and the connection assembly comprising a biased interference member to ensure the connection assembly remains engaged until the strength reducing formation fails, the interference member movable between a first position where the interference member contacts the connection assembly and a second position where the interference member no longer contacts the connection assembly; and a piston having a seat to receive a hydraulic isolation device capable of sealing a flow of fluid through the tool, the piston attached to the sleeve, wherein the piston is movable from a first non-contact position relative to the interference member to a second position whereby the piston contacts a shoulder of the interference member to move the interference member into the second position to release the connection assembly thereby allowing the first and second member to disconnect.

9. The tool in claim 8, wherein the connection assembly includes a threaded surface on an outer surface of the first member and another threaded surface on an inner surface of the second member.

10. The tool of claim 8, wherein the piston moves to the second position at a predetermined fluid pressure, thereby causing the sleeve to fail.

11. The tool of claim 8, wherein the interference member is biased by a spring.

12. The tool of claim 8, wherein substantially the entire length of a contact surface between the interference member and the connection assembly is tapered.

13. A method of operating a disconnect in a wellbore tubular string, comprising:

running the tubular string into the wellbore, the tubular string having the disconnect disposed as a portion therein;

increasing a pressure in the wellbore and thereby applying an axial force to a tensile sleeve, wherein the tensile sleeve is isolated from any other applied axial force, and failing the tensile sleeve with the applied axial force;

causing a retaining member to move to a non-supporting position relative to a connection member in response to the failure of the tensile sleeve, and thereby releasing a first portion of the disconnect from a second portion of the disconnect; and sensing a pressure change caused by a fluid bypass, thereby indicating the initial separation of the first and second portions.

14. The method of claim 13, wherein the tensile sleeve is initially at a non-contact position relative to the retaining member.

15. The method of claim 14, wherein the retaining member is out of engagement with the connection member in the non-supporting position.

16. A disconnect device in a wellbore, comprising:

a first portion;

a second portion separable from the first portion;

a retaining sleeve for retaining a connection member;

a piston movable from a first non-contact position relative to a shoulder of the retaining sleeve to a second position, whereby in the second position the piston contacts said shoulder on the retaining sleeve and urges the retaining sleeve out of engagement with the connection member and against a biasing member to separate the first and second portions; and a fluid by pass providing a pressure change thereby, indicating the initial separation of the first and second portions.

* * * * *